US008655514B2

(12) United States Patent
Noffsinger et al.

(10) Patent No.: US 8,655,514 B2
(45) Date of Patent: Feb. 18, 2014

(54) SYSTEMS AND METHODS FOR COMMUNICATIONS BASED RAIL VEHICLE CONTROL

(75) Inventors: Joseph Forrest Noffsinger, Lee's Summit, MO (US); Jeffrey Baker, Grain Valley, MO (US); Jerome Beshoner, Pleasant Hill, MO (US)

(73) Assignee: General Electric Company, Schenectady, NY (US)

( * ) Notice: Subject to any disclaimer, the term of this patent is extended or adjusted under 35 U.S.C. 154(b) by 547 days.

(21) Appl. No.: 12/948,817

(22) Filed: Nov. 18, 2010

(65) Prior Publication Data

US 2012/0130567 A1 May 24, 2012

(51) Int. Cl.
*G05D 1/00* (2006.01)

(52) U.S. Cl.
USPC ..... 701/19; 701/29.1

(58) Field of Classification Search
USPC ..... 701/19, 36, 20, 29.1–29.6
See application file for complete search history.

(56) References Cited

U.S. PATENT DOCUMENTS

| | | | | |
|---|---|---|---|---|
| 7,340,509 | B2 * | 3/2008 | Daum et al. | 709/220 |
| 7,366,589 | B2 * | 4/2008 | Habermas | 701/1 |
| 2002/0107616 | A1 * | 8/2002 | Delaruelle | 701/19 |
| 2003/0055666 | A1 * | 3/2003 | Roddy et al. | 705/1 |
| 2005/0102661 | A1 | 5/2005 | De Boer et al. | |
| 2009/0106749 | A1 | 4/2009 | Daum et al. | |

FOREIGN PATENT DOCUMENTS

EP 0139217 B1 5/1987

* cited by examiner

*Primary Examiner* — Richard Camby
(74) *Attorney, Agent, or Firm* — GE Global Patent Operation; John A. Kramer

(57) ABSTRACT

Systems and methods for controlling a rail vehicle are provided. In one embodiment, a rail vehicle system includes a first version of a travel database including travel information, a communication link to receive a second version of the travel database, and a controller configured to, in response to the second version of the travel database including changes to the travel information that meet predefined override criteria, control operation of the rail vehicle system based on the first version of the travel database; and in response to the changes to the travel information not meeting the predefined override criteria, adjust operation of the rail vehicle system to operate based on the second version of the travel database.

25 Claims, 4 Drawing Sheets

SYSTEMS AND METHODS FOR COMMUNICATIONS BASED RAIL VEHICLE CONTROL

FIELD

The subject matter disclosed herein relates to communications based control of a rail vehicle.

BACKGROUND

A rail vehicle, such as locomotive, that typically employs a communications based control system includes a database on-board the rail vehicle that contains attributes of the territory through which the rail vehicle travels. The database is typically uploaded from a master control source to the rail vehicle at the beginning of a trip. In some cases, a database is updated to change various attributes that reflect changing conditions of the territory. A rail vehicle that is already in motion on a trip when the database is updated has an originating version of the database which is no longer current when the database is changed by the master control source. During the trip, when the rail vehicle enters a new wayside zone of the territory, a wayside device transmits a query to the communications based control system on-board the rail vehicle to check for the current version of the database. When the rail vehicle detects that the on-board version of the database is not the current version, the system is configured so that the rail vehicle is commanded to go to a safe state (e.g., stop) and download the current version of the database to the communications based control system on-board the rail vehicle.

However, under some conditions, changes in the updated database are not relevant to operation of the rail vehicle during the trip, even in the new zone of the territory. Thus, stopping to upload the current version of the database generates an unnecessary disruption to operation that reduces efficiency and prolongs the trip of the rail vehicle.

BRIEF DESCRIPTION

Accordingly, to address the above issues, various embodiments of systems and methods for communications based rail vehicle control are described herein. For example, in one embodiment, a rail vehicle system comprises a first version of a travel database including travel information, a communication link to receive a second version of the travel database, and a controller. When the communication link receives the second version of the travel database, such as when the rail vehicle approaches or enters a new wayside control zone, the controller is configured to, in response to the second version of the travel database including changes to the travel information that meet one or more predefined override criterion, control operation of the rail vehicle system based on the first version of the travel database; and in response to the changes to the travel information not meeting the one or more predefined override criterion, adjust operation of the rail vehicle system to operate based on the second version of the travel database. ("Override" criterion means a criterion used to assess whether to bypass a default operation, in this case, automatic updating of a travel database.) By continuing to control operation of the rail vehicle based on the first version of the database when the changes to the second version of the database meet a predefined override criterion or criteria, such as changes that do not impact operation of the rail vehicle, disruption of operation of the rail vehicle can be reduced. In this way, rail vehicle operating efficiency can be increased and rail vehicle trip times can be decreased.

This brief description is provided to introduce a selection of concepts in a simplified form that are further described below in the detailed description. This brief description is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

The present disclosure is directed to systems and methods for communications based rail vehicle control. More particularly, the present disclosure is directed to systems and methods for determining whether or not content of an updated version of a travel database downloaded to a rail vehicle meets one or more predefined criterion. For example, in one embodiment, if the content of the update meets predefined criteria to override an adjustment in operation to a safe state, rail vehicle operation continues without updating the travel control database to the latest version. Otherwise, rail vehicle operation is disrupted and the rail vehicle operation is adjusted in order to download an updated version of the travel database to the communications based control system on-board the rail vehicle. Accordingly, by determining whether or not to download an updated version of a the travel database based on the predetermined criterion or criteria, widespread deployment of communications based rail vehicle control systems can be implemented while reducing the impact to rail vehicle operations of making certain travel database updates.

Figure 1:
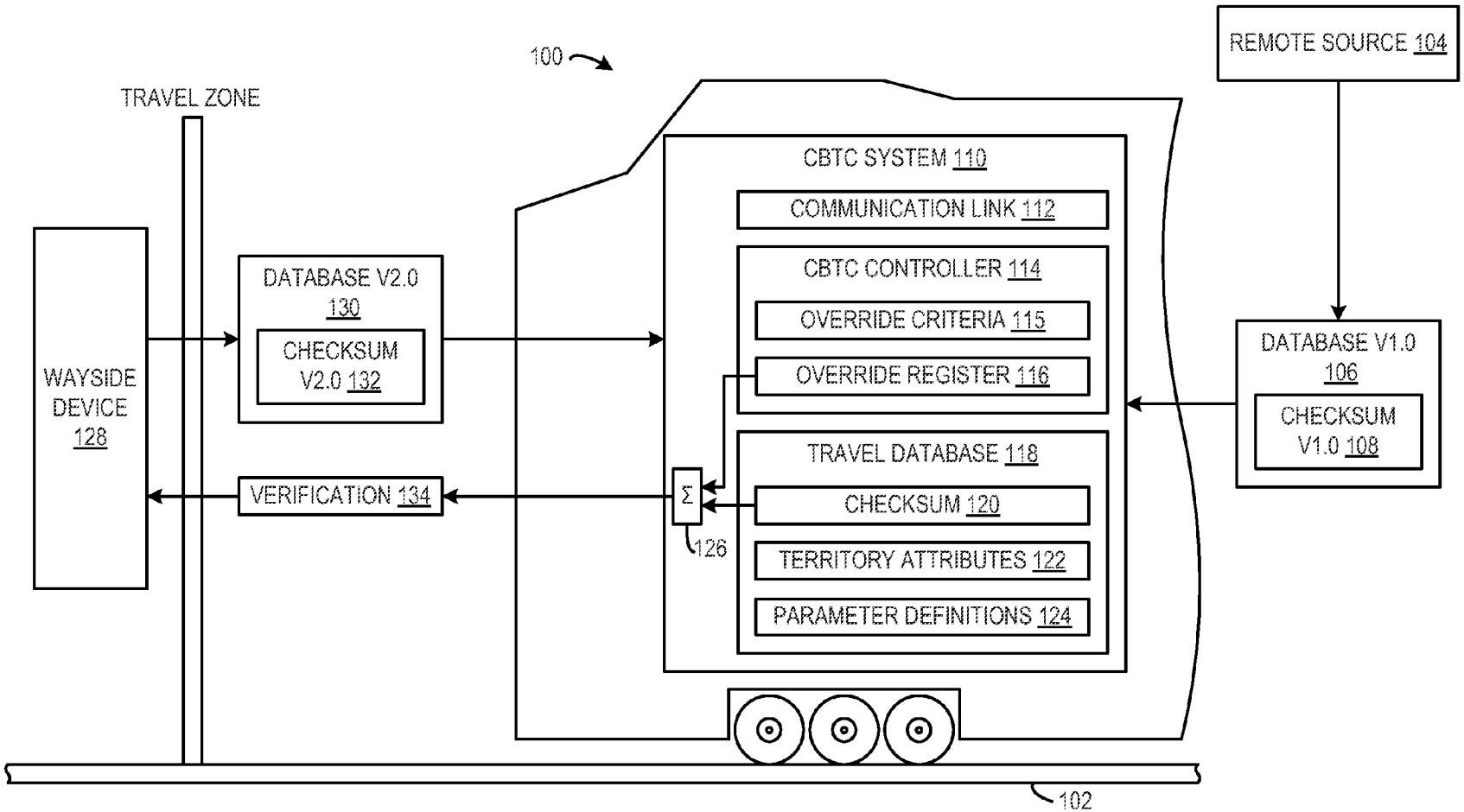
FIG. 1 is a schematic diagram of an example embodiment of a rail vehicle of the present disclosure.

FIG. 1 is a schematic diagram of an example embodiment of a vehicle or vehicle system, herein depicted as a rail vehicle 100, configured to travel on a rail 102. In one example, the rail vehicle 100 is a diesel-electric vehicle that includes a diesel engine (not shown) that generates a torque output that is converted to electricity by an alternator (not shown) for subsequent propagation to a variety of downstream electrical components, such as a plurality of traction motors (not shown) to provide tractive power to propel the rail vehicle 100.

A communications based rail vehicle (e.g., train) control (CBTC) system 110 is positioned in the rail vehicle 100 to monitor location and movement of the rail vehicle 100 and communicate movement authority of the rail vehicle 100 to various traffic control and/or communication devices of a territory through which the rail vehicle 100 travels. The CBTC system 110 includes a communication link 112 to send and receive travel information. The CBTC system 110 includes a CBTC controller 114 to monitor location and travel of the rail vehicle 100 by managing operation of the communication link 112 and performing other operations, such as enforcing movement authority of the rail vehicle 100. Travel information and movement authority are retrieved from a travel database 118; the travel information may include territory attributes 122 and parameter definitions 124 that characterize a territory where the rail vehicle 100 travels. The travel database 118 is stored in a storage device of the CBTC system 110, such as in the CBTC controller 114. The territory attributes 122 include a catalog of geometry and features of the railroad tracks throughout the territory. For example, the territory attributes includes the grade of the track, the locations of the different wayside zones, the position of various wayside devices, communication devices, traffic control devices, and the like. The parameter definitions 124 include values for different parameters that affect travel of the rail vehicle 100 throughout the territory. For example, the parameter definitions include travel restrictions such as movement authorities and speed limits, which can be wayside zone or track dependent.

Prior to embarking on a trip, the rail vehicle 100 receives, through the communication link 112, an original version 106 (e.g., first version) of the travel database 118 from a remote source 104 that is downloaded to the CBTC system 110. The original version 106 of the travel database 118 includes travel information that is current when the rail vehicle 100 embarks on the trip. In one example, the original version 106 of the travel database 118 includes a checksum 108 that corresponds uniquely to the original version 106. When the original version 106 of the travel database 118 is downloaded to the CBTC system 110, the CBTC controller 114 verifies that the downloaded version of the travel database 118 corresponds to the latest version (which at the time is the original version 106). In particular, the CBTC controller 114 verifies that a checksum 120 corresponding to a downloaded version of the travel database 118 matches the checksum 108 of the original version 106. The checksum is employed to improve communication integrity by verifying that information is downloaded correctly and a desired version of the travel database is downloaded to the rail vehicle 100.

Furthermore, during various points throughout the trip, the CBTC system 110 communicates with wayside devices 128 or other devices, such as base stations, to check for an updated version of the travel database as well as to check the integrity of the downloaded version of the travel database. In one example, when the rail vehicle 100 approaches a new travel zone, the CBTC system 110 announces the presence of the rail vehicle to the wayside device 128 that controls the travel zone. Correspondingly, upon receiving the announcement, the wayside device 128 sends the latest version 130 (e.g., second version) of the travel database including a corresponding checksum 132 to the CBTC system 110. The CBTC system 110 determines if the latest version 130 corresponds to the version downloaded to the CBTC system 110. In one example, the determination is made by comparing the checksum of each version. If it is determined that the checksums match, then the previously downloaded version is the latest version and the rail vehicle 100 continues through the travel zone. Otherwise, if the checksums do not match, the downloaded version is outdated or inaccurate.

As discussed above, in some cases, an updated version of the travel database may have changes relative to the downloaded version of the travel database that are not relevant to the rail vehicle 100 during the trip or that otherwise meet a predefined override criterion or criteria 115. In one example, the predefined override criteria 115 include changes that do not affect operation of the rail vehicle 100. For example, the override criteria include changes to labels of objects in the travel database, such as changing the label of a mile post marker. As another example, the predefined override criteria include changes made at a location that is greater than a threshold distance from the location of the rail vehicle, such as changes to a location more than a travel zone away from the rail vehicle or changes at a location outside of the predetermined trip of the rail vehicle. As yet another example, the predefined override criteria 115 include changes to state parameter values of rail vehicles of a different type than the rail vehicle 100. For example, the weight of a locomotive that is different than the rail vehicle 100 is updated to reflect a change in configuration. This change does not affect operation of the rail vehicle 100, and thus meets the predefined override criteria. On the other hand, the predefined override criteria 115 do not include changes that affect operation of the rail vehicle 100. For example, changes that do not meet the predefined override criteria 115 may include changes to the geometry of the track, changes to the location of various features (e.g., switches, wayside devices, etc.), and changes to state parameter values of the rail vehicle 100.

Stopping operation of the rail vehicle 100 to download the latest version when the update is irrelevant unnecessarily disrupts operation and prolongs the trip. To avoid such disruptions, when it is determined that the currently downloaded version (e.g., first version) is not the latest version, the CBTC controller 114 determines whether or not changes between the downloaded version (e.g., first version) and the latest version (e.g., second version) meet the predefined override criterion or criteria 115. In cases where the changes to the travel database do meet the predefined override criterion or criteria 115, the CBTC controller 114 sends a verification 134 to the wayside device 128 that the version is the latest version or is a version that is appropriate for CBTC operation. In one example, the CBTC controller 114 places a value in an override register 116 that is the difference between the downloaded checksum 120 and the current checksum 132. A sum of the value in the override register 116 and the downloaded checksum 120 is included in the verification 134 to the wayside device 128. Since the value included in the verification 134 matches the current checksum 132, the rail vehicle is granted movement authority and continues travel into the new control zone. In this case, control of the rail vehicle 100 is based on the originating version of the travel database independent of the updated version, since changes in the updated version do not affect operation of the rail vehicle 100.

In cases where the changes to the travel database do not meet the predefined override criterion or criteria, the CBTC controller 114 commands operation of the rail vehicle 100 to be adjusted (e.g., stopped) so that the latest travel plan can be downloaded, compiled, and used for CBTC operation. In one example, the CBTC controller 114 places a value in an override register 116 that is a number other than difference between the downloaded checksum 120 and the current checksum 132. A sum of the value in the override register 116 and the downloaded checksum 120 is included in the verification 134 to the wayside device 128. Since the value included in the verification 134 does not match the current checksum 132, the rail vehicle is not granted movement authority and stops to download the current version of the travel database 130. Once the updated version is downloaded, control of the rail vehicle 100 is based on the updated version independent of the outdated version that was previously downloaded. By employing the override register to selectively verify a travel database checksum as designated for use based on predefined override criteria, unnecessary disruption of rail vehicle operation is reduced in a manner that is beneficial for applications where data communications bandwidth is limited. Moreover, the override register for the checksum verification can be implemented into existing data messages, so that shutdown override capabilities can be added to legacy rail vehicles.

Continuing with FIG. 1, the communication link 112 communicates with the remote source 104, such as a central control office, the wayside devices 128, and other traffic control and communication devices to send and receive travel information. In particular, the communication link 112 sends rail vehicle state and location information to the remote source 104 and/or wayside devices 128. Correspondingly, the communication link 112 receives the travel database 106 (e.g., first version) from the remote source 104 before embarking on a trip. Later during the trip, the communication link 112 receives the updated travel database 130 (e.g., second version) from the wayside device 128. In one example, the communication link 112 includes a radio transceiver for wireless communication. In one example, the communication link includes a global positioning system (GPS) device to determine a location of the rail vehicle 100 that is sent to the remote source 104 and/or the wayside device 128. In one example, the CBTC system 110 is capable of operating in either dark (non-signaled) or signaled territory by employing GPS navigation to track the location of the rail vehicle 100 while operating with the downloaded travel database 118.

In one example, the wayside devices 128 are positioned at intervals within the broadcast range of the communication link 112 to stay in communication during travel. In one example, the wayside device 128 includes antennas and radios with multi-channel receivers that send and receive radio signals up and down the length of the railroad track. If there are several tracks in an area, the wayside device 128 includes a bank of radio channels that different rail vehicles can log onto and communicate with during traveling throughout a zone.

The CBTC controller 114 manages operation of the CBTC system 110. In one example, the CBTC controller 114 includes a computer system including a processor and a non-transitive storage device that holds the travel database 118 as well as instructions that when executed perform operations to control the CBTC system 110. For example, the CBTC controller 114 enforces travel restrictions including movement authorities that prevent unwarranted movement of the rail vehicle 100. In some embodiments, the CBTC system 110 controls operation of the rail vehicle to comply with the movement authorities. Based on travel information such as the territory attributes 122 and the parameter definitions 124 in the travel database 118, the CBTC controller 114 determines the location of the rail vehicle 100 and how fast it can travel based on the travel restrictions, and determines if movement enforcement is performed to adjust the speed of the rail vehicle 100. In this way, rail vehicle collisions, over speed derailments, incursions into work zones, and/or travel through an improperly positioned switch can be reduced or prevented. As an example, the CBTC controller 114 provides commands to slow or stop the rail vehicle 100 in order to comply with a movement authority. As another example, the CBTC controller 114 provides commands to stop the rail vehicle 100 in order to download a latest version of the travel database when a predefined override criterion or criteria are not met.

The travel database 1188 is stored in a storage device of the CBTC system 110, such as in the CBTC controller 114. Travel information stored in the travel database 118 is used to track the location and movement of the rail vehicle. In one example, the travel information stored in the travel database 118 includes territory attributes 122 and parameter definitions 124. The territory attributes 122 include a catalog of geometric and other features of the railroad tracks throughout the territory. For example, the territory attributes include the grade of the track and other attributes of railroad track geometry, the locations of the different wayside zones, the positions/locations of various wayside devices, communication devices, mile post markers, and traffic control devices, and the like. The parameter definitions 124 include values for different parameters that affect travel of the rail vehicle 100 throughout the territory. For example, the parameter definitions include travel restrictions such as movement authorities and speed limits and other speed regulations, which can be wayside zone or track dependent. In some cases, the parameter definitions include rail vehicle state information for different types of rail vehicles that travel through the territory. In one example, the state information includes the length, weight, height; braking capacity, etc. that are different for different types of rail vehicles.

Figure 2:
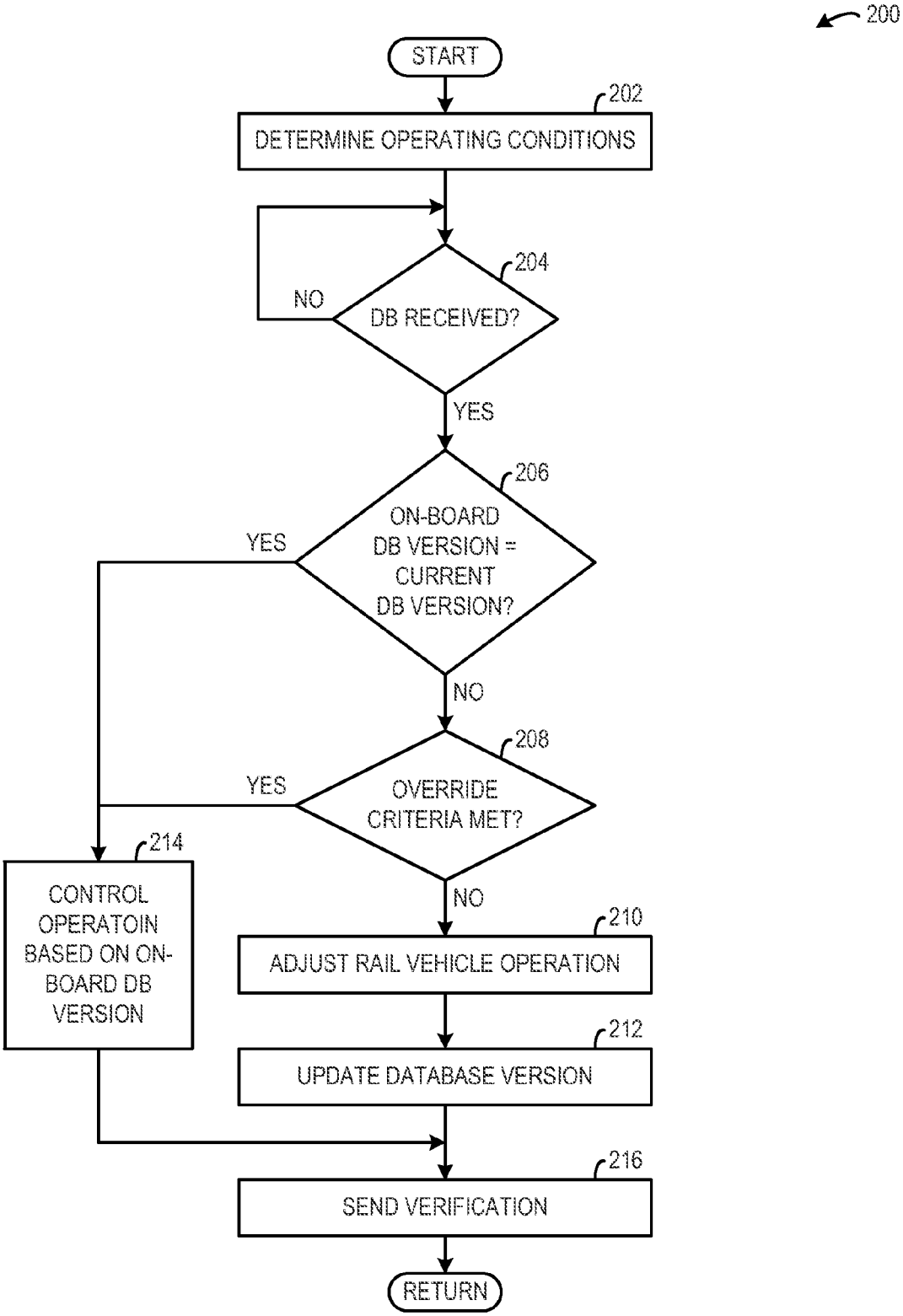
FIG. 2 is a flow diagram of an example embodiment of a method for controlling a rail vehicle based on a state of an on-board operation database.

FIG. 2 is a flow diagram of an example embodiment of a method 200 for controlling a rail vehicle based on a state of an on-board operation database. More particularly, the method 200 selectively accepts two different versions (e.g., first and second versions) of a travel database as equivalent so as not to disrupt rail vehicle operation for updating the travel database based on a predefined override criterion or criteria. In one example, the method is performed by the CBTC controller 114.

At 202, the method includes determining operating conditions. Determining operating conditions includes determining the version of the travel database 118 that is downloaded to the CBTC system 110. In one example, determining operating conditions includes determining a checksum corresponding to the downloaded travel database. Furthermore, determining operating conditions includes determining rail vehicle state and location information.

At 204, the method includes determining if a database update message is received. In one example, the database update message is received in response the rail vehicle approaching or entering a different travel zone of a territory. It will be appreciated that a database update message may be received at other times and/or locations, instead of, or in addition to approaching or entering a different travel zone. In one example, the database update message is sent from the wayside device 128, in response to detection of the rail vehicle 100 by the wayside device 128. In one example, the database update message is sent from the wayside device 128 in response to the CBTC controller 114 announcing the presence of the rail vehicle 100 to the wayside device 128. If it is determined that a database update message is received, the method moves to 206. Otherwise, the method returns to 204.

At 206, the method includes determining if an on-board (previously downloaded) version of the travel database is the current version of the travel database. In one example where version-specific checksums are employed, the determination is performed by comparing the checksum of the downloaded version of the travel database (e.g., first version) to the checksum of the latest version of the travel database (e.g., second version) sent from the wayside device. If the checksums match or are equal to each other, the downloaded version is the current version. If the checksums do not match, the downloaded version is not the current version. If it is determined that the downloaded version is not the current version, the method moves to 208. Otherwise, the method moves to 214.

At 208, the method includes determining if a predefined override criterion or criteria are met for not downloading the latest version of the travel database (e.g., second version) and continuing travel of the rail vehicle under control based on the downloaded version of the travel database (e.g., first version). In one example, the predefined override criterion or criteria include changes to the travel database that are directed to a different type of rail vehicle other than the rail vehicle 100. For example, a height parameter of a locomotive that is not the rail vehicle 100 is updated to reflect a change in configuration, and the change meets the predefined override criteria since it does not affect operation of the rail vehicle. In one example, the predefined override criterion or criteria include changes that do not impact operations of the rail vehicle, such as changing a title or reference label of an object in the travel database (e.g., changing a mile post marker label). In one example, the predefined override criterion or criteria include changes to the travel database in areas that are greater than a predefined distance from the location of the rail vehicle. For example, changes made to a track that is not included in a next travel zone through which the rail vehicle is traveling, or an entirety of a predetermined trip of the rail vehicle meet the predefined override criteria. Moreover, changes to the travel database that do not impact operation of the rail vehicle may meet the predefined override criteria.

On the other hand, in an embodiment, changes to the travel database that do not meet the predefined override criterion or criteria include changes that impact operation of the rail vehicle. In one example, changes that do not meet the predefined override criteria include physical changes to a track, such as a change in grade, a change in location of a switch or crossing, etc. that are less than a threshold distance from the rail vehicle, such as in a zone of travel of the rail vehicle. In one example, changes that do not meet the predefined override criteria include changes to the speed restrictions and/or movement authority inside the zone of travel of the rail vehicle. If it is determined that the changes to the travel database meet the one or more predefined override criterion, the method moves to 214. Otherwise, the method moves to 210.

At 210, the method includes adjusting rail vehicle operation. Adjusting rail vehicle operation may include commanding the rail vehicle into a safe state. For example, the CBTC controller 114 commands the rail vehicle 100 to stop operation. Rail vehicle operation is stopped to reduce the likelihood of operation based on an outdated version of the travel database that impacts operation of the rail vehicle.

At 212, the method includes updating a version of the travel database to the current version. In one example, the current version of the travel database (e.g., second version) is received from the wayside device 128 and is compiled by the CBTC controller 114 for control of operation of the rail vehicle 100. In one example, operation of the rail vehicle is stopped until the updated version of the travel database is downloaded and compiled for operation based on the updated version of the travel database. The CBTC controller 114 controls operation of the rail vehicle 100 based on the updated version of the travel database independent of the outdated version of the travel database. The outdated version is not used for control of the rail vehicle, because it includes outdated travel information that affects operation of the rail vehicle and does not meet the predefined override criterion or criteria. Movement authority is reestablished by the rail vehicle in response to operation based on the updated version of the travel database.

At 214, the method includes controlling operation based on the downloaded (or not current) version of the travel database (e.g., first version). The downloaded version of the travel database can be used for controlling operation because changes made to the updated version of the travel do not impact operation of the rail vehicle or the downloaded version is the latest version. The CBTC controller 114 controls operation of the rail vehicle 100 based on the downloaded version of the travel data base and independent of the updated version of the travel database, since changes in the updated version do not affect operation of the rail vehicle.

At 216, the method includes sending a verification whether or not the version of the travel database downloaded to the rail vehicle is current or does not impact operation of the rail vehicle. In other words, the verification provides an indication of whether or not the version of the database is acceptable for movement authority of the rail vehicle. The verification is sent to the wayside device 128 (or remote source 104) for establishing/controlling movement authority. In some cases, the verification indicates that the downloaded version of the travel database is the current version, and the rail vehicle is granted movement authority. In one example, where the downloaded version is the current version, the CBTC controller 114 sets the value in the override register 116 to zero since the checksum of the downloaded version matches the checksum of the current version. The verification includes a sum of the value in the override register and the checksum of the downloaded version to indicate that the checksum of the downloaded version matches the checksum of the current version, and the rail vehicle is granted movement authority. In one example, where the downloaded version is not the current version, but meets the predefined override criteria, the CBTC controller 114 sets the value of the override register 116 to the difference between the checksum of the current version and the checksum of the downloaded version. When the checksum of the downloaded version and the value in the override register are summed, the result is equal to the checksum of the current version. The verification includes this sum to indicate that the downloaded version of the travel database is acceptable for control of the rail vehicle, and the rail vehicle is granted movement authority.

In some cases, the verification indicates that the downloaded version of the travel database is not the current version, and the rail vehicle is not granted movement authority. In one example, where the downloaded version is not the current version and does not meet the predefined override criteria, the CBTC controller 114 sets the value of the override register 116 to zero (or another arbitrary number that is not the difference between the checksums). The verification includes a sum of the value in the override register and the checksum of the downloaded version to indicate that the downloaded version of the travel database is not acceptable for control of the rail vehicle, and the rail vehicle is not granted movement authority until operation is adjusted to control operation of the rail vehicle based on the latest version of the travel database.

By selectively accepting two different versions of a travel database as equivalent when changes between the versions meet one or more predefined override criterion and do not impact operation of the rail vehicle, disruption of rail vehicle operation for updating the version of the travel database is reduced. In this way, rail vehicle operation efficiency is increased and trip time is reduced since the rail vehicle stops less often to update the travel database.

Figure 3:
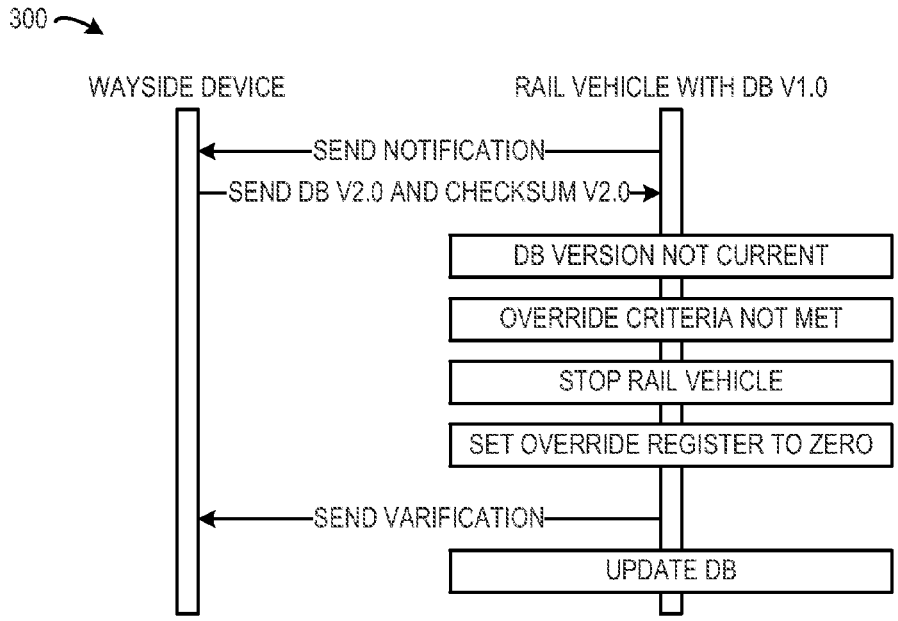
FIG. 3 is a sequence diagram depicting an example scenario where a version of a travel database on-board a rail vehicle is checked to determine if it is the current version of the travel database.

FIG. 3 is a sequence diagram depicting an example scenario 300 where a version of a travel database on-board a rail vehicle is checked to determine if it is the current version of the travel database. In the scenario 300, a rail vehicle operating with an originating version of a travel database sends a notification to a wayside device alerting the wayside device of the presence of the rail vehicle. In response to receiving the notification, the wayside device sends information about the current version of the travel database, including the checksum corresponding to the current version to the rail vehicle. The wayside device may further send the current version of the database as well. The CBTC system compares the checksum of the version of the downloaded (originating) travel database to the checksum of the current database. The checksums do not match, since the downloaded version is the originating version and not the current version (e.g., V1.0 not V2.0). The CBTC system determines if the changes in the current version meet the predefined override criterion or criteria. In other words, the CBTC system determines whether or not the changes do not impact operation of the rail vehicle. Here, the changes do not meet the predefined override criterion or criteria, so the CBTC commands that the rail vehicle be stopped and the current version of the travel database be downloaded and compiled for operation (or just compiled if the current version has already been downloaded). The CBTC system sets the value in the override register to zero (or another arbitrary number) so that when the override register and the checksum of the downloaded version are summed, the result is not equal to the checksum of the current version. The summed result is sent as part of verification to the wayside device, and the rail vehicle is not granted movement authority until the rail vehicle is operating with the current version of the travel database. Accordingly, the latest version of the travel database is downloaded and compiled for operation by the rail vehicle.

Figure 4:
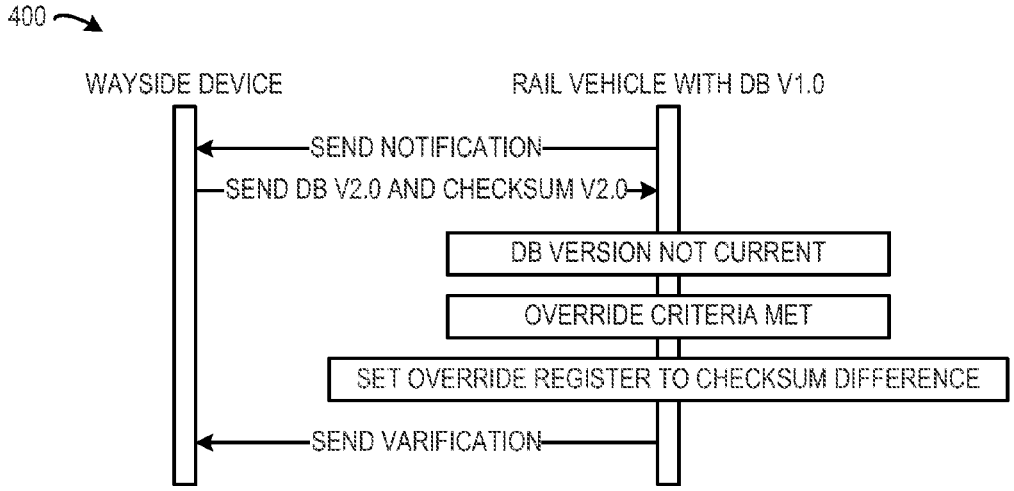
FIG. 4 is a sequence diagram depicting another example scenario where a version of a travel database on-board a rail vehicle is checked to determine if it is the current version of the travel database.

FIG. 4 is a sequence diagram depicting another example scenario 400 where a version of a travel database on-board a rail vehicle is checked to determine if it is the current version of the travel database. In the scenario 400, a rail vehicle operating with an originating version of a travel database sends a notification to a wayside device alerting the wayside device of the presence of the rail vehicle. In response to receiving the notification, the wayside device sends information about the current version of the travel database, including the checksum corresponding to the current version to the rail vehicle. The CBTC system compares the checksum of the version of the downloaded travel database to the checksum of the current database. Here, the checksums do not match, since the downloaded version is the originating version and not the current version (e.g., V1.0 not V2.0). The CBTC system determines if the changes in the current version meet the predefined override criterion or criteria. In other words, the CBTC system determines whether or not the changes do not impact operation of the rail vehicle. The CBTC system determines that the changes meet the predefined override criteria and do not impact operation of the rail vehicle. The CBTC system sets the value in the override register to the difference between the checksum of the downloaded version and the checksum of the current version, so that when the override register and the checksum of the downloaded version are summed, the result is equal to the checksum of the current version. The summed result is sent as part of a verification to the wayside device, and the rail vehicle is granted movement authority since the checksums are accepted as equivalent.

Figure 5:
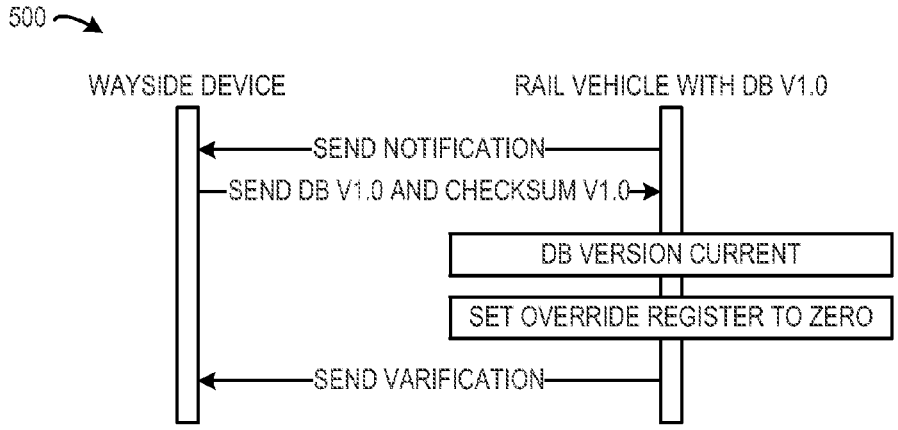
FIG. 5 is a sequence diagram depicting yet another example scenario where a version of a travel database on-board a rail vehicle is checked to determine if it is the current version of the travel database.

FIG. 5 is a sequence diagram depicting yet another example scenario 500 where a version of a travel database on-board a rail vehicle is checked to determine if it is the current version of the travel database. In the scenario 500, a rail vehicle operating with an originating version of a travel database, sends a notification to a wayside device alerting the wayside device of the presence of the rail vehicle. In response to receiving the notification, the wayside device sends the current version of the travel database including the checksum corresponding to the current version to the rail vehicle. In this scenario the travel database has not been updated since the rail vehicle has embarked on the trip. Accordingly, the current version is the same as the originating version. The CBTC system compares the checksum of the version of the downloaded travel database to the checksum of the current database. The checksums match since the downloaded version is the same as the current version (e.g., they are both V1.0). The CBTC system sets the value in the override register to zero so that when the override register and the checksum of the downloaded version are summed, the result is remains equal to the checksum of the current version. The summed result is sent as part of a verification to the wayside device, and the rail vehicle is granted movement authority since the checksums are accepted as equivalent.

In an embodiment, an on-board system of a vehicle (e.g., rail vehicle) determines if a first version of a travel database, currently in place aboard the vehicle, is different from a second, possibly more recent/updated version of the travel database. If not, operation of the vehicle continues according to the first version. If so, a determination is made, either on board or off board the vehicle, of whether differences between the first and second versions meet one or more designated criterion for (i) bypassing replacing the first version with the second version or (ii) replacing the first version with the second version. In regards to the former, it is assumed that the first version would normally be replaced by the second version if there is any difference between the two. Thus, if the differences meet the one or more criterion, it means the differences are not sufficient and/or of a particular character to warrant replacing the first version with the second version and operating the vehicle according to the second version. On the other hand, if the differences fail to meet the one or more criterion, it means the differences are of suitable magnitude and/or character to warrant allowing the first version to be replaced by the second version. In regards to the latter, the default action is not to replace the first version with the second version, even if there are differences. Instead, an assessment is made of whether the differences are of a suitable character and/or magnitude to warrant replacement, and if so, the first version is replaced by the second version.

Another embodiment relates to a vehicle system. The system comprises a first version of a travel database that includes travel information. The system further comprises a communication link to receive a second version of the travel database. The system further comprises a controller configured to, in response to the second version of the travel database including changes to the travel information that meet one or more predefined criterion, control operation of the vehicle system based on one of the first version or the second version of the travel database. The controller is further configured, in response to the changes to the travel information not meeting the one or more predefined criterion, to control operation of the vehicle system based on the other one of the first version or the second version of the travel database. In one embodiment, if the changes to the travel information meet the one or more predefined criterion (e.g., an override criterion), operation of the vehicle system is controlled based on the first version, and if the changes do not meet the one or more predefined criterion, the second version replaces the first version and the vehicle system is controlled based on the second version. In another embodiment, if the changes to the travel information meet the one or more predefined criterion, the second version replaces the first version and the vehicle system is controlled based on the second version, and if the changes to the travel information do not meet the one or more predefined criterion, operation of the vehicle system is controlled based on the first version.

Another embodiment relates to a vehicle system comprising a first version of a travel database that includes travel information. The first version of the travel database is on board a vehicle. The system further comprises a communication link on the vehicle to receive a second version of the travel database. The system further comprises a controller operably coupled to the communication link on the vehicle. The controller is configured to, in response to the second version of the travel database including changes to the travel information that meet one or more predefined criterion, control operation of the vehicle based on one of the first version or the second version of the travel database; and in response to the changes to the travel information not meeting the one or more predefined criterion, control operation of the vehicle based on the other one of the first version or the second version of the travel database.

Another embodiment relates to a control method for a vehicle. The method comprises determining if differences in travel information content between a first version of a travel database and a second version of a travel database meet one or more predefined criterion. (The first version of the travel database is located on board the vehicle.) If so, the vehicle is controlled based on one of the first version of the travel database or the second version of the travel database. If not, the vehicle is controlled based on the other one of the first version of the travel database or the second version of the travel database.

In another embodiment of the control method, the one or more predefined criterion comprises one or more predefined override criterion. If the differences in travel information content between the first version of the travel database and the second version of the travel database meet the one or more predefined override criterion, the vehicle is controlled based on the first version of the travel database. However, if the differences in travel information content between the first version of the travel database and the second version of the travel database do not meet the one or more predefined override criterion, the second version of the travel database is downloaded to the vehicle from an off board source for replacing the first version with the second version, and the vehicle is controlled based on the second version of the travel database.

In another embodiment of the control method, if the differences in travel information content between the first version of the travel database and the second version of the travel database meet the one or more predefined criterion, the second version of the travel database is downloaded to the vehicle from an off board source for replacing the first version with the second version, and the vehicle is controlled based on the second version of the travel database. However, if the differences in travel information content between the first version of the travel database and the second version of the travel database do not meet the one or more predefined override criterion, the vehicle is controlled based on the first version of the travel database.

Figure 6:
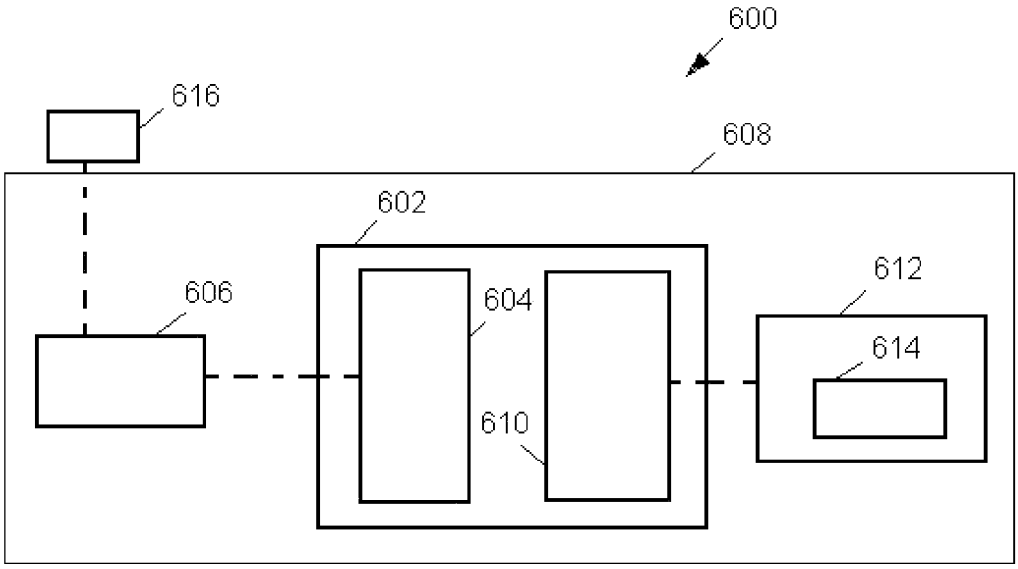
FIG. 6 is a schematic diagram of a vehicle system, according to another embodiment of the invention.

With reference to FIG. 6, another embodiment relates to a vehicle system 600. The vehicle system 600 comprises a control module 602 having a first interface module 604 for interfacing with a communication link 606 of a vehicle 608 and a second interface module 610 for interfacing with a memory 612 that stores a first version 614 of a travel database. The control module is configured to determine if differences in travel information content between the first version of the travel database and a second version 616 of the travel database meet one or more predefined criterion. If so, the control module is configured to carry out a first operation comprising one of leaving the first version of the travel database as-is in the memory or replacing the first version of the travel database with the second version of the travel database in the memory. If not, the control module is configured to carry out a second operation comprising the other one of leaving the first version of the travel database as-is in the memory or replacing the first version of the travel database with the second version of the travel database in the memory. The control module may comprise hardware and/or software elements that operate on or in conjunction with a vehicle control system of the vehicle, e.g., the control module and/or each interface module 604, 610 may be a software or other functional module for controlling a vehicle control system for carrying out the indicated functions.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A rail vehicle system comprising:

a first version of a travel database including travel information;

a communication link to receive a second version of the travel database; and a controller configured to, in response to the second version of the travel database including changes to the travel information that meet one or more predefined override criterion, control operation of the rail vehicle system based on the first version of the travel database; and in response to the changes to the travel information not meeting the one or more predefined override criterion, adjust operation of the rail vehicle system to operate based on the second version of the travel database.

2. The system of claim 1, wherein the controller includes an override register, the first version of the travel database includes a first checksum, the second version of the travel database includes a second checksum; and the controller being configured to, in response to the first checksum equaling the second checksum, control operation of the rail vehicle system based on the first version of the travel database, set a value in the override register to zero, and send, through the communication link, a verification including a sum of the value and the first checksum to indicate that the first version of the travel database is acceptable for movement authority of the rail vehicle system.

3. The system of claim 1, wherein the controller includes an override register, the first version of the travel database includes a first checksum, the second version of the travel database includes a second checksum; and the controller being configured to, in response to the first checksum not equaling the second checksum and the changes meeting the one or more predefined override criterion, control operation of the rail vehicle system based on the first version of the travel database, set a value in the override register to a difference between the first checksum and the second checksum, and send, through the communication link, a verification including a sum of the value and the first checksum to indicate that the first version of the travel database is acceptable for movement authority of the rail vehicle system.

4. The system of claim 1, wherein the controller includes an override register, the first version of the travel database includes a first checksum, the second version of the travel database includes a second checksum; and wherein the controller is configured to, in response to the first checksum not equaling the second checksum and the changes not meeting the one or more predefined override criterion, set a value in the override register to a number that is not a difference between the first checksum and the second checksum, send, through the communication link, a verification including a sum of the value and the first checksum to indicate that the first version of the travel database is not acceptable for movement authority of the rail vehicle system, and prior to establishing movement authority of the rail vehicle system, adjust operation of the rail vehicle system to operate based on the second version of the travel database.

5. The system of claim 1, wherein changes to the travel information that meet the one or more predefined override criterion include changes to the travel information that do not affect operation of the rail vehicle.

6. The system of claim 5, wherein changes to the travel information that meet the one or more predefined override criterion include a change to a label of an object positioned in a territory characterized by the travel database.

7. The system of claim 1, wherein changes to the travel information that meet the one or more predefined override criterion include changes to travel information that characterize a location that is greater than a threshold distance from a location of the rail vehicle.

8. The system of claim 1, wherein the travel database includes state information for a plurality of different types of rail vehicles, and wherein changes to the travel information that meet the one or more predefined override criterion include changes to the state information for a rail vehicle of a different type than the rail vehicle system.

9. The system of claim 1, wherein changes to the travel information that do not meet the one or more predefined override criterion include at least one of a change to a geometric feature of a railroad track, a change to a speed restriction, and a change to a movement authority.

10. A method for controlling operation of a rail vehicle, comprising:

controlling operation of the rail vehicle based on a first version of a travel database including travel information;

receiving a second version of the travel database and/or information about the second version of the travel database;

in response to the second version of the travel database including changes to the travel information that meet one or more predefined override criterion, continue controlling operation of the rail vehicle based on the first version of the travel database; and in response to the changes to the travel information not meeting the one or more predefined override criterion, adjusting operation of the rail vehicle system to operate based on the second version of the travel database.

11. The method of claim 10, further comprising:

in response to the second version of the travel database including the changes to the travel information that meet the one or more predefined override criterion, sending a verification including an indication that the first version of the travel database is acceptable for movement authority of the rail vehicle.

12. The method of claim 10, further comprising:

in response to the changes to the travel information not meeting the one or more predefined override criterion, sending a verification including an indication that the first version of the travel database is not acceptable for movement authority of the rail vehicle; and stopping travel of the rail vehicle until the second version of the travel database is downloaded and compiled for control of the rail vehicle based on the second version of the travel database.

13. The method of claim 10, wherein the first version of the travel database includes a first checksum, and the second version of the travel database includes a second checksum, further comprising:

in response to the first checksum equaling the second checksum, continue controlling operation of the rail vehicle system based on the first version of the travel database;

set a value in an override register to zero; and send a verification including a sum of the value and the first checksum to indicate that the first version of the travel database is acceptable for movement authority of the rail vehicle.

14. The method of claim 13, further comprising:

in response to the first checksum not equaling the second checksum and the changes meeting the one or more predefined override criterion, continue controlling operation of the rail vehicle system based on the first version of the travel database;

set a value in the override register to a difference between the first checksum and the second checksum;

send a verification including a sum of the value and the first checksum to indicate that the first version of the travel database is acceptable for movement authority of the rail vehicle system.

15. The method of claim 13, further comprising:

in response to the first checksum not equaling the second checksum and the changes not meeting the one or more predefined override criterion, set a value in the override register to a value that is not the difference between the first checksum and the second checksum;

send a verification including a sum of the value and the first checksum to indicate that the first version of the travel database is not acceptable for movement authority of the rail vehicle system; and prior to establishing movement authority of the rail vehicle system, stopping travel of the rail vehicle until the second version of the travel database is downloaded and compiled for control of the rail vehicle system based on the second version of the travel database.

16. The method of claim 10, wherein changes to the travel information that meet the one or more predefined override criterion include at least one of a change to a label of an object positioned in a territory characterized by the travel database, a change to travel information that characterizes a location that is greater than a threshold distance from a location of the rail vehicle, and a change to state information for a rail vehicle of a different type than the rail vehicle.

17. The method of claim 10, wherein changes to the travel information that do not meet the one or more predefined override criterion include at least one of a change to a geometric feature of a railroad track, a change to a speed restriction, and change to a movement authority.

18. A control method for a vehicle, the method comprising:

determining if differences in travel information content of a travel territory of the vehicle between a first version of a travel database and a second version of a travel database meet one or more predefined criterion that would require the vehicle to enter a safe state, the first version of the travel database located on board the vehicle;

if so, controlling the vehicle based on one of the first version of the travel database or the second version of the travel database; and if not, controlling the vehicle based on the other one of the first version of the travel database or the second version of the travel database.

19. The control method of claim 18, wherein:

the one or more predefined criterion comprises one or more predefined override criterion;

if the differences in travel information content between the first version of the travel database and the second version of the travel database meet the one or more predefined override criterion, the vehicle is controlled based on the first version of the travel database; and if the differences in travel information content between the first version of the travel database and the second version of the travel database do not meet the one or more predefined override criterion, the second version of the travel database is downloaded to the vehicle from an off board source for replacing the first version with the second version, and the vehicle is controlled based on the second version of the travel database.

20. The control method of claim 18, wherein:

if the differences in travel information content between the first version of the travel database and the second version of the travel database meet the one or more predefined criterion, the second version of the travel database is downloaded to the vehicle from an off board source for replacing the first version with the second version, and the vehicle is controlled based on the second version of the travel database; and if the differences in travel information content between the first version of the travel database and the second version of the travel database do not meet the one or more predefined override criterion, the vehicle is controlled based on the first version of the travel database.

21. The control method of claim 18, wherein prior to controlling the vehicle based on the second version of the travel database, the second version of the travel database is downloaded from a source off board the vehicle and the first version of the travel database is replaced with the second version of the travel database for operation of the vehicle.

22. A system comprising:

a first version of a travel database including travel information, the first version having a first checksum;

a communication link to receive a second version of the travel database having a second checksum; and a controller configured to, in response to the first checksum equaling the second checksum, control operation of the rail vehicle system based on the first version of the travel database, set a value in an override register to zero, and send, through the communication link, a verification including a result of a sum of the value and the first checksum to indicate that the first version of the travel database is acceptable for movement authority of the rail vehicle system, in response to the first checksum not equaling the second checksum and the changes meeting one or more predefined override criterion, control operation of the rail vehicle system based on the first version of the travel database, set the value in the override register to a difference between the first checksum and the second checksum, and send, through the communication link, a verification to include a result of a sum of the value and the first checksum to indicate to a wayside device that the first version of the travel database is acceptable for movement authority of the rail vehicle system, and in response to the first checksum not equaling the second checksum and the changes not meeting the one or more predefined override criterion, set the value in the override register to a number that is not the difference between the first checksum and the second checksum, send, through the communication link, a verification including a result of a sum of the value and the first checksum to indicate that the first version of the travel database is not acceptable for movement authority of the rail vehicle system, and prior to establishing movement authority of the rail vehicle system, adjust operation of the rail vehicle system to operate based on the second version of the travel database.

23. The system of claim 21, wherein changes to the travel information that meet the one or more predefined override criterion include at least one of a change to a label of an object positioned in a territory characterized by the travel database, a change to travel information that characterizes a location that is greater than a threshold distance from a location of the rail vehicle system, and a change to state information for a rail vehicle of a different type than the rail vehicle system.

24. The system of claim 21, wherein changes to the travel information that do not meet the one or more predefined override criterion include at least one of a change to a geometric feature of a railroad track, a change to a speed restriction, and change to a movement authority.

25. A vehicle system comprising:

a control module having a first interface module for interfacing with a communication link of a vehicle and a second interface module for interfacing with a memory that stores a first version of a travel database;

wherein the control module is configured to determine if differences in travel information content between the first version of the travel database and a second version of the travel database meet one or more predefined criterion, and if so, the control module is configured to carry out a first operation comprising one of leaving the first version of the travel database as-is in the memory or replacing the first version of the travel database with the second version of the travel database in the memory, and if not, the control module is configured to carry out a second operation comprising the other one of leaving the first version of the travel database as-is in the memory or replacing the first version of the travel database with the second version of the travel database in the memory.

* * * * *